United States Patent [19]

Seshimoto et al.

[11] 4,363,829

[45] Dec. 14, 1982

[54] PROCESS FOR FORMING AN ELECTRICALLY CONDUCTIVE FILM

[75] Inventors: Osamu Seshimoto; Hirotsugu Nomaguchi; Seiji Horie; Hideo Sato; Masaaki Takimoto; Kikuo Kubotera, all of Asaka, Japan

[73] Assignee: Fuji Photo Film Co., Ltd., Kanagawa, Japan

[21] Appl. No.: 181,556

[22] Filed: Aug. 27, 1980

[30] Foreign Application Priority Data

Aug. 27, 1979 [JP] Japan ..... 54-109446

[51] Int. Cl.[3] ..... B05D 3/06

[52] U.S. Cl. ..... 427/53.1; 252/500; 427/54.1; 430/58; 430/59; 430/62; 430/527; 204/159.2; 250/423 P; 250/212

[58] Field of Search ..... 252/500, 501.1; 427/53.1, 54.1; 204/159.18, 159.2

[56] References Cited

U.S. PATENT DOCUMENTS

| | | | |
|---|---|---|---|
| 3,629,158 | 12/1971 | Perez-Albuerne | 252/500 |
| 3,634,336 | 1/1972 | Perez-Albuerne | 252/500 |
| 4,026,905 | 5/1977 | Cohen et al. | 252/500 |

*Primary Examiner*—John H. Newsome

*Attorney, Agent, or Firm*—Sughrue, Mion, Zinn, Macpeak & Seas

[57] ABSTRACT

A process for forming an electrically conductive film by exposing to actinic radiation a coating that contains a nonionic electron donating compound and a halogen-substituted polymer having film-forming properties on a substrate, thereby forming a charge transfer complex in said halogen-substituted polymer in said coating.

12 Claims, No Drawings

PROCESS FOR FORMING AN ELECTRICALLY CONDUCTIVE FILM

BACKGROUND OF THE INVENTION

1. Field of the Invention

This invention relates to a process for forming an electrically conductive film by exposing to actinic radiation a coating that contains a nonionic electron donating compound and a halogen-substituted polymer having film-forming properties on a substrate. More particularly, the invention relates to a process for forming an electrically conductive film that contains a charge transfer complex in said halogen-substituted polymer in said coating.

2. Description of the Prior Art

The theory of the electrification of electric insulators is not fully understood, but it is known that it is a phenomenon that occurs at the interface of two insulators. As one insulator is contacted by or rubbed with another, or as the insulators are separated from each other, mechanical energy applied is converted to electrical energy in the form of static electricity. Such process of electrification is further complicated by the fact that it varies depending on the particular combination of insulators that are contacted or rubbed together.

Electrification of insulators has often presented serious problems in the industrial use of insulators. For example, it is well known that the phenomenon has fatal effects on certain sensitive materials, such as photographic photosensitive materials. The generation of static electricity on a photosensitive material can cause a static mark by the discharge of said electricity. Static marks present a very difficult problem because they cannot be detected until after the photographic material is developed. There are two main practical methods for preventing the electrification of insulators. One is to reduce the rate of static generation, and the other is to increase the rate of static dissipation. The former method either utilizes the rank of insulating materials in the triboelectric series or reduces the contact resistance of insulators. The latter method is based on increasing the electrical conductivity of the material in one way or another. In any event, the two methods are usually combined to attempt to achieve adequate control of static charges.

Most of the antistatic agents (antistats) developed to date are used in the latter method. Ion-conductive antistats are typical of these agents, and they are applied to or adsorbed on the surface of an insulator or they are incorporated in the insulator to increase its conductivity by reducing the specific resistance of the surface. Most antistats of this type comprise certain surfactants, and intrinsically they need some moisture for their effectiveness. Additionally, their effectiveness decreases rapidly during storage or under ambient conditions.

Considerable efforts have been made to develop an antistat less susceptible to temperature and moisture, particularly to moisture. One example of such efforts involves vacuum-deposition of a metal or conductive inorganic material on the surface of a polymeric film to increase its conductivity. However, not only is the conductive film thus-prepared expensive, but the conductive coating is also easily separated from the substrate by external forces. A conductive film can also be made by finely dispersing a metal or conductive carbon black into a polymer. But making the film by this method without sacrificing its physical properties involves much difficulty.

Recently, some organic charge transfer complexes have been found to have high electrical conductivity and many studies have been reported on their synthesis (e.g., G. H. Perlstein, *Angew. Chem. Internat. Ed.*, Vol. 16, pp. 519–534 (1977) and A. F. Garito & A. J. Heeger, *ACC Chem. Res.*, Vol. 7, p. 232 (1974)). However, it is difficult to produce a conductive film from only an organic charge transfer complex synthesized by a conventional method because the complex is generally available in a powder form which either has no film-forming properties or forms only a weak film. Therefore, the usual practice is to form a film by dispersing the complex in a polymer, but only few solvents can dissolve the complex and the resulting solution is often labile. Furthermore, if the complex is dispersed after it is ground with a ball mill, the very structure of the complex can be destroyed. For these reasons, it has been difficult to produce a uniform coating from such a complex.

U.S. Pat. No. 3,634,336 describes a method of producing a conductive film using a charge transfer complex. The electron donors illustrated in the patent are acetic acid salts of polynuclear aromatic compounds having a chalcogen as a central atom, and a desired conductive film is obtained by converting the salts to an effective charge transfer complex through anion exchange.

SUMMARY OF THE INVENTION

As a result of various studies to eliminate the defects of the conventional technique, a method has now been found for forming an electrically conductive film using an organic charge transfer complex produced by a method different from the conventional technique. The method of this invention is used with advantage for preventing the electrification of materials that are required to have a surface electrical resistance of less than $10^{13}$ ohms, and preferably less than $10^{10}$ ohms, such as photographic photosensitive materials and magnetic tapes. In particular, the method finds much utility in the antistatic treatment of photographic films that are required to have a high degree of transparency as well as conductivity.

This invention provides (1) a process for forming an electrically conductive film by exposing to actinic radiation a coating on a substrate that contains a nonionic electron donating compound and a halogen-substituted polymer having film-forming properties, thereby forming a charge transfer complex in said halogen-substituted polymer in said coating; and (2) a process for forming an electrically conductive film according to (1) above wherein the coating contains a halogen radical generating agent.

DETAILED DESCRIPTION OF THE INVENTION

The conductive charge transfer complex (hereinafter referred to as ChTC) formed in this invention is a complex compound represented by $(D_x)^{n\oplus}(A_y)^{n\ominus}$. It is easily formed by the transfer of electrons between a nonionic neutral electron donating compound (represented by D) which is brought into contact with a halogen-substituted polymer capable of generating a radical (represented by A). In the above formula for the complex compound, x is the total number of molecules of neutral or cationic D compounds; y is the total number of molecules of neutral or anionic A compounds; n is the total number of charges in ionized D or A; x and y are both positive integers; D and A may be a single compound or a mixture of two or more compounds. Unlike the method described in U.S. Pat. No. 3,634,336 which forms a charge transfer complex by an ion exchange reaction, the method of this invention forms a charge transfer complex in a polymer matrix by direct reaction between an electron donating compound and a halogen radical.

Examples of the electron donating compound used in this invention include diphenylamines according to formula (I) below; fulvalenes according to formula (II) below; naphthalenes according to formula (III) below; anthracenes according to formula (IV) below; dipyrans according to formula (V) below; azines according to formula (VI) below; ethylenes according to formula (VII) below; and benzo[1,2-d:5,4-d']bisthiazoles according to formula (VIII) below. These neutral compounds may be used independently or as mixtures thereof.

(I)

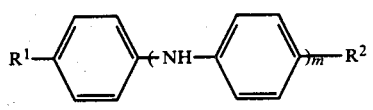

(II)

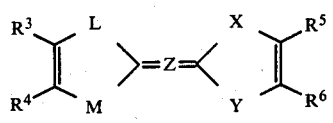

(III)

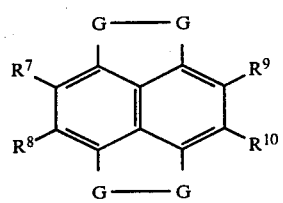

(IV)

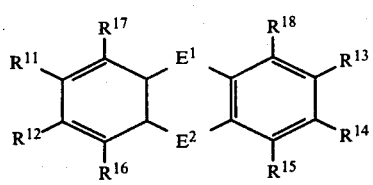

(V)

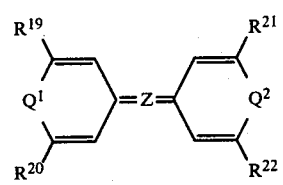

(VI)

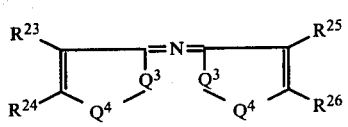

(VII)

$Q^5—CH=CH—Q^6$ (VIII)

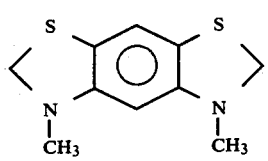

In the foregoing formula (I), m is an integer of from 1 to 6; $R^1$ and $R^2$, which may be the same or different, represent hydrogen, an amino group, or a dialkylamino group (illustrative alkyls thereof include methyl, ethyl and propyl).

In the formula (II), L, M, X and Y, which may be the same or different, represent O, S, Se or $$-\overset{\overset{R^a}{|}}{N}-;$$

Z represents either a direct double bond between the two adjacent heterocyclic rings or an indirect bond through =N—N= or =CH—CH=. Specific examples of a compound having the chemical structure of the formula (II) include tetrathiofulvalenes (wherein all of L, M, X and Y are S); tetraselenafulvalenes (wherein all of L, M, X and Y are Se); diselenadithiafulvalenes (wherein L and M are S, and X and Y are Se; L and Y are S, and M and X are Se; or L and X are S, and M and Y are Se); compounds wherein L and Y are S, and M and X are N—$R^a$ (wherein $R^a$ is an alkyl group having from 1 to 10 carbon atoms, which is preferably methyl, ethyl or propyl); compounds wherein L and X are S, and M and Y are N—$R^a$ (wherein $R^a$ is the same as defined above); compounds wherein L and X are O, and M and Y are N—$R^a$ (wherein $R^a$ is the same as defined above); and compounds wherein L and X are N—$R^a$, and M and Y are N—$R^b$ (wherein $R^a$ is the same as defined above and $R^b$ has the same meaning as in $R^a$, and $R^a$ and $R^b$ may be the same or different). In the formula (II), L and X and/or M and Y may be bonded by —$CH_2$—$CH_2$—. Also in the formula (II), $R^3$, $R^4$, $R^5$ and $R^6$ may be the same or different, and each represents hydrogen, an alkyl group having from 1 to 10 carbon atoms, a substituted alkyl group (exemplary substituents include cycloalkyl, hydroxyl, cyano, alkylcarbonylamino, carboxyl, alkoxy, alkoxycarbonyl and carbamoyl) having from 1 to 10 carbon atoms in the alkyl portion thereof, a cycloalkyl group, an aralkyl group, an aryl group, a substituted aryl group (the substituent thereof can be the same as the example substituents noted for the substituent of the substituted alkyl group), an alkenyl group (e.g., vinyl or allyl), a formyl group, a trifluoromethyl group or an alkylthio group; $R^3$ and $R^4$ and/or $R^5$ and $R^6$, when taken together, may form a methylene chain (having 3 to 5 carbon atoms), a group represented by $$-CH_2=\underset{\underset{R^c}{|}}{C}-CH=CH_2-$$

(wherein $R^c$ is hydrogen or an alkyl group), or a substituted methylene chain (e.g., $-(CH_2)_aS-(CH_2)_b$, wherein a and b are each 2 or 3).

These fulvalenes can be synthesized by a known method, for example, the method described in the article by M. Narita, C. U. Pittman, Jr., *Synthesis* (1976), p. 489.

In the formula (III), G represents S or Se, and $R^7$, $R^8$, $R^9$ and $R^{10}$ each has the same meaning as that of $R^3$ of the formula (II). Further details of the structure of the compounds of the formula (III) are provided in U.S. Pat. No. 3,634,336, hereby incorporated by reference.

In the formula (IV), $E^1$ and $E^2$ may be the same or different, and are each O, S or

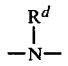

wherein $R^d$ is hydrogen, an alkyl group having from 1 to 10 carbon atoms, or substituted alkyl group (examples of the substituent thereof include the same as the example substituents noted for the substituent of the substituted alkyl group $R^3$ above), $R^{11}$ through $R^{18}$ may be the same or different, and are each the same as $R^3$, and any of $R^{13}$ and $R^{18}$, $R^{14}$ and $R^{15}$, $R^{12}$ and $R^{16}$, or $R^{11}$ and $R^{17}$, when taken together, may form a —CH=CH—CH=CH— group.

In the formula (V), Z has the same meaning as Z of the formula (II), $Q^1$ and $Q^2$ are each Se, S or O, and $R^{19}$, $R^{20}$, $R^{21}$ and $R^{22}$, which may be the same or different, each has the same meaning as $R^3$ above.

In the formula (VI), $Q^3$ and $Q^4$ are each Se, S or O, and $R^{23}$, $R^{24}$, $R^{25}$ and $R^{26}$, which may be the same or different, each has the same meaning as $R^3$ above.

In the formula (VII), $Q^5$ and $Q^6$ represent

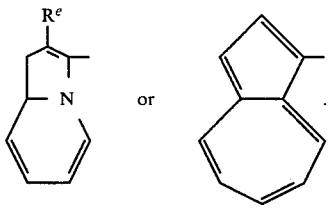

Examples of the halogen-substituted polymer having film-forming properties used in this invention include the polymers described in Kobunshi, Vol. 11, No. 128, pp. 1052–1053 (1962), the polymers described in *Polymer Handbook,* 2nd Ed., pp. I-1 to I-13, J. Brandrup, E. H. Immergut, John Wiley & Sons, Inc., as well as the brominated p-vinylphenol polymer repeating unit

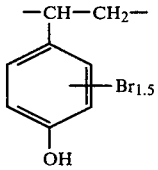

(average molecular weight: 6,000 to 24,000), chlorinated polyethylene (with a chlorine content in the range of from about 60 to about 75 wt%), chlorinated polypropylene (with a chlorine content in the range of from about 60 to about 75 wt%), polyvinyl chloride, vinyl chloride-vinylidene chloride copolymer (including from 20 to 80% of vinyl chloride by molar ratio), vinylidene chloride-acrylonitrile copolymer (including from 10 to 30% of acrylonitrile by molar ratio), vinyl chloride-acrylonitrile copolymer (including from 10 to 30% of acrylonitrile by molar ratio), and vinyl chloride-vinyl acetate copolymer.

These polymers may be used independently or as a mixture thereof. They may also be used in combination with a general-purpose polymer.

In this invention, a halogen radical generating agent that is decomposed by heat or light to generate a halogen radical can also be used. One example of the halogen radical generating agent is an N-halogen compound represented by the formula (IX)

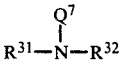

(IX)

wherein $Q^7$ is halogen, $R^{31}$ and $R^{32}$ are each an alkyl group of $C_1$ to $C_{10}$, a substituted alkyl group (the substituent is the same as the examples given for the substituent of the substituted alkyl group $R^3$) or an acyl group of $C_1$ to $C_{10}$; $R^{31}$ and $R^{32}$ may be the same or different and may, when taken together, form a carbon ring or heterocyclic ring (as in

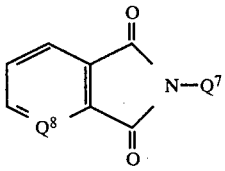

wherein $Q^7$ is halogen and $Q^8$ is N, O or S).

Illustrative N-halogen compounds are N-bromo-ε-caprolactam, N-bromosuccinimide, N-chlorosuccinimide, N-bromoacetamide, N-bromophthalazinone (m.p. 158°–160° C.), tribromo-s-triazine-2,4,6(1H, 3H, 5H)-trione (m.p. 290° C.), 1-bromobenztriazole (m.p. 100° C.), N-bromo-3-azabenzocumara-2,4-dione, N-bromoxazolinone (m.p. 122.5°–123° C.), N-bromobenzoxazolinone (m.p. 230° C.), N-bromo-3-methylpyrazoline-5-one, N-bromo-3,4-dimethylpyrazoline-5-one, N-bromo-3-phenylpyrazoline-5-one, N-bromobenzosulfonylamide (m.p. 80° C.), N-bromo-N-methylbenzosulfonylamide (m.p. 103.5° C.), N-bromomorpholine-2-one (m.p. 104° C.), N-bromo-2-pyrrolidinone (m.p. 99° C.), and 2,4,4,6-tetrabromo-2,5-cyclohexadiene-1-one. Still other examples are the organic halogen compounds illustrated in Japanese Patent Publication No. 8330/76 as a photoactivator, and halogenated compounds described in the Abstract of the papers presented by C. Holstead and J. Bailey at the *Symposium on Unconventional Photographic Systems,* 1977, sponsored by the Royal Photographic Society, Great Britain.

Any solvent can be used in this invention if it dissolves the electron donating compound, halogen-substituted polymer (binder) and the optionally added halogen radical generating agent. Illustrative solvents are: water, chain alkanes such as n-pentane, n-hexane, n-octane and isooctane, and cyclic alkanes such as cyclohexane; nitriles such as acetonitrile and butyronitrile; ketones such as acetone, methyl ethyl ketone, methyl isobutyl ketone, cyclohexanone, and diisobutyl ketone; esters such as ethyl acetate, butyl acetate, amyl acetate, methyl formate, ethyl propionate, dimethyl phthalate, and ethyl benzoate; aromatic hydrocarbons such as toluene, xylene, benzene and ethylbenzene; halogenated hydrocarbons such as dichloromethane, carbon tetrachloride, trichloroethylene, chloroform, 1,1,1-trichloroethane, monochlorobenzene, dichlorobenzene, trichlorobenzene, and chloronaphthalene; ethers such as tetrahydrofuran, diethyl ether, ethylene glycol monomethyl ether, and ethylene glycol monoethyl ether acetate; and dimethylformamide and dimethyl sulfoxide.

A wide variety of materials can be used as substrate in this invention, such as fabrics, film, glass, paper, and metal, whether they are treated or untreated.

The process of this invention is now described more specifically. A film that contains an electron donating compound, a halogen-substituted polymer having film-forming properties; and optionally a halogen radical generating agent is formed on a substrate by coating, immersion or any other suitable means. Subsequently, the substrate is exposed to actinic radiation to form a charge transfer complex in the film to thereby render the substrate electrically conductive. If necessary, the substrate may be heated. By suitably selecting the light source to which the substrate is exposed and the exposure period, a conductive film having a surface electrical resistance in the range of from $10^{13}$ to $10^{7}$ ohms can be formed. The film (coating) is formed on the substrate in a thickness ranging from about 0.05 to 500 $\mu$m, and preferably from about 0.1 to 50 $\mu$m.

The content of the electron donating compound with respect to the final polymer [the electron donating compound/(electron donating compound+halogen substituted polymer)] is from about 1 to 99 wt%, and preferably from about 5 to 60 wt%.

The actinic radiation as used in this invention is near ultraviolet light having a wavelength of from about 290 nm to 400 nm, and vacuum ultraviolet light having a wavelength of from about 190 nm to 290 nm. No exact period of exposure to actinic radiation can be determined since it depends upon the illuminance (i.e., energy density) of the light, but generally, it can be selected from a relatively wide range as long as the illuminance is neither so low nor so high as to make the operation of exposure difficult. The time of exposure to actinic radiation is generally in the range of from about 1 second to about 3 hours, and preferably from about 2 seconds to about 2 hours.

The method of this invention can provide a highly transparent conductive film, because the reaction of the complex formation occurs in the binder or on the interface and very fine particles of conductive, charge transfer complex are formed. The electrically conductive film produced by this invention can effectively prevent the electrification of many insulators even if it has a tendency to scatter light. The conductive film that contains fine particles of charge transfer complex of 1 $\mu$m or less in size is combined to particular advantage with a photosensitive material as an antistat layer in a photographic photosensitive material or as a conductive layer in an electrophotographic photosensitive material.

This invention is now described in greater detail by reference to the following examples, which are given here for illustrative purposes only, and are not intended to limit the scope of the invention.

EXAMPLE 1

A mixture of 0.25 part by weight of a brominated p-vinylphenol polymer (repeating unit:

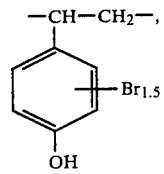

average molecular weight: 6,000 to 24,000), 0.061 part by weight of bis(benzo-1,3-dithiol-2-ylidene) (referred to as BBDY), and 0.033 part by weight of carbon tetrabromide was dissolved in a solvent comprising a mixture of 5 parts by weight of methyl ethyl ketone and 15 parts by weight of chloroform, and the solution was applied to a glass substrate. The film was exposed to a low-pressure mercury vapor lamp (comprising four germicidal lamps, National Sakkinto GL-10 of Matsushita Electric Industrial Co., Ltd., total output 40 W) placed 5 cm away, and it was observed that the surface electrical resistance of the film decreased as the exposure time increased, as shown in Table 1 below.

TABLE 1

| Exposure Time (min) | Not Exposed | 4 | 8 | 12 | 16 | 20 | 24 | 28 |
|---|---|---|---|---|---|---|---|---|
| Surface electrical resistance (Ω) | $9.0 \times 10^{11}$ | $1.3 \times 10^{11}$ | $4.5 \times 10^{10}$ | $2.0 \times 10^{10}$ | $1.4 \times 10^{10}$ | $1.2 \times 10^{10}$ | $9.0 \times 10^{9}$ | $7.6 \times 10^{9}$ |

EXAMPLES 2 TO 6

Mixtures of 0.122 part by weight of BBDY and 0.5 part by weight of the halogen-substituted polymers indicated in Table 2 below were dissolved in 45 parts by weight of chloroform, and the solutions were applied to glass substrates. The substrates were exposed to a low-pressure mercury vapor lamp the same as used in Example 1, a brominated p-vinylphenol polymer was used as the halogen-substituted polymer and it was dissolved in a solvent comprising a mixture of 30 parts by weight of chloroform and 8 parts by weight of methyl ethyl ketone. The exposure periods and surface electrical resistance values of the respective films are also shown in Table 2.

TABLE 2

| Example No. | Exposure Time (minutes) Not Exposed | 4 | 8 | 12 | 16 | 20 | Binder |
|---|---|---|---|---|---|---|---|
| 2 | $1.3 \times 10^{13}\Omega$ | $5 \times 10^{11}\Omega$ | $1.1 \times 10^{11}\Omega$ | $4.5 \times 10^{10}\Omega$ | $3.5 \times 10^{10}\Omega$ | $2.7 \times 10^{10}\Omega$ | Vinylphenol polymer brominated |
| 3 | $5.2 \times 10^{12}\Omega$ | $2.1 \times 10^{12}\Omega$ | $5 \times 10^{11}\Omega$ | $3.1 \times 10^{11}\Omega$ | $2.2 \times 10^{11}\Omega$ | $2.0 \times 10^{11}\Omega$ | CPE |
| 4 | $2.6 \times 10^{13}\Omega$ | $1.6 \times 10^{12}\Omega$ | $5.2 \times 10^{11}\Omega$ | $1.9 \times 10^{11}\Omega$ | $1.9 \times 10^{11}\Omega$ | $1.9 \times 10^{11}\Omega$ | CPP |
| 5 | $4.4 \times 10^{13}\Omega$ | $2.1 \times 10^{13}\Omega$ | $2.2 \times 10^{12}\Omega$ | $7 \times 10^{11}\Omega$ | $7 \times 10^{11}\Omega$ | $7 \times 10^{11}\Omega$ | VCVAc |

TABLE 2-continued

| Example No. | Exposure Time (minutes) Not Exposed | 4 | 8 | 12 | 16 | 20 | Binder |
|---|---|---|---|---|---|---|---|
| 6 | $3.8 \times 10^{13}\Omega$ | $2.5 \times 10^{11}\Omega$ | $1.3 \times 10^{11}\Omega$ | $1.3 \times 10^{11}\Omega$ | $1.3 \times 10^{11}\Omega$ | $1.3 \times 10^{11}\Omega$ | VdCAn |

(Notes)
CPE: Polyethylene chloride (with chlorine content of 69 wt %)
CPP: Polypropylene chloride (with chlorine content of 69 wt %)
VCVAc: Vinyl chloride (75 mol %)-Vinyl acetate (25 mol %) copolymer
VdCAn: Vinylidene chloride (80 mol %)-Acrylonitrile (20 mol %) copolymer

EXAMPLE 7

The procedure of Example 2 was repeated except that the light source was a high-pressure mercury vapor lamp (output 100 W) placed 5 cm away.

The results are shown in Table 3 below.

TABLE 3

| Exposure Time (min) | Not Exposed | 20 | 40 | 60 | 80 | 100 | 120 |
|---|---|---|---|---|---|---|---|
| Surface electrical resistance (Ω) | $2.3 \times 10^{13}$ | $1.3 \times 10^{13}$ | $6.1 \times 10^{11}$ | $2.9 \times 10^{11}$ | $1.2 \times 10^{11}$ | $6.1 \times 10^{10}$ | $4.1 \times 10^{10}$ |

EXAMPLE 8

The procedures of Examples 3 to 6 were repeated except that the light source was a high-pressure mercury vapor lamp (output 100 W) placed 5 cm away. The results were similar to those of Example 7 except that the surface electrical resistance of the films was decreased at slower rate.

EXAMPLE 9

The procedures of Examples 2 to 6 were repeated except that the glass substrate was replaced by a transparent, colorless polyethylene terephthalate film subbed with gelatin. The results were substantially the same as in Examples 2 to 6.

While the invention has been described in detail and with reference to specific embodiments thereof, it will be apparent to one skilled in the art that various changes and modifications can be made therein without departing from the spirit and scope thereof.

What is claimed is:

1. A process for forming an electrically conductive film by exposing to actinic radiation a coating that contains a nonionic electron donating compound and a halogen-substituted polymer having film-forming properties on a substrate, thereby forming a charge transfer complex in said halogen-substituted polymer in said coating.

2. A process for forming an electrically conductive film according to claim 1 wherein the coating contains a halogen radical generating agent.

3. A process for forming an electrically conductive film as in claim 1 or 2 wherein the coating on the substrate is from about 0.05 to 500 μm thick.

4. A process for forming an electrically conductive film as in claim 1 or 2 wherein the coating on the substrate is from about 0.1 to 50 μm thick.

5. A process for forming an electrically conductive film as in claim 1 or 2 wherein the content of the electron donating compound is from about 1 to 99 wt%.

6. A process for forming an electrically conductive film as in claim 3 wherein the content of the electron donating compound is from about 1 to 99 wt%.

7. A process for forming an electrically conductive film as in claim 4 wherein the content of the electron donating compound is from about 1 to 99 wt%.

8. A process for forming an electrically conductive film as in claim 1 or 2 wherein the content of the electron donating compound is from about 5 to 60 wt%.

9. A process for forming an electrically conductive film as in claim 3 wherein the content of the electron donating compound is from about 5 to 60 wt%.

10. A process for forming an electrically conductive film as in claim 4 wherein the content of the electron donating compound is from about 5 to 60 wt%.

11. A process for forming an electrically conductive film as in claim 1 or 2 wherein the actinic radiation has a wavelength of from about 290 nm to 400 nm.

12. A process for forming an electrically conductive film as in claim 1 or 2 wherein the actinic radiation is vacuum ultraviolet light having a wavelength of from about 190 nm to 290 nm.

* * * * *